US005762013A

United States Patent [19]

Watanabe et al.

[11] Patent Number: 5,762,013

[45] Date of Patent: Jun. 9, 1998

[54] BOBBIN CASING ASSEMBLY AND SEWING MACHINE HAVING SAME

[75] Inventors: Mitsuo Watanabe; Takashi Yamashita, both of Tokyo, Japan

[73] Assignee: Juki Corporation, Tokyo, Japan

[21] Appl. No.: 496,091

[22] Filed: Jun. 28, 1995

[30] Foreign Application Priority Data

Jun. 29, 1994 [JP] Japan ..... 6-148166

[51] Int. Cl.[6] ..... D05B 57/22; D05B 57/14

[52] U.S. Cl. ..... 112/181; 112/231

[58] Field of Search ..... 112/231, 228, 112/181, 182, 189, 190, 467

[56] References Cited

U.S. PATENT DOCUMENTS 3,921,551 11/1975 Gustmann et al. ..... 112/181

4,142,475 3/1979 Zocher ..... 112/181

5,492,072 2/1996 Yamashita ..... 112/228

FOREIGN PATENT DOCUMENTS 99353 2/1933 Japan .

*Primary Examiner*—Peter Nerbun

*Attorney, Agent, or Firm*—Morgan, Lewis & Bockius LLP

[57] ABSTRACT

A bobbin casing assembly for a sewing machine having a driver, a main shaft, and a needle bar. The bobbin casing assembly comprises a bobbin casing and an engaging member protruding outwardly from the bobbin casing, an upper end of the engaging member being disposed below an upper surface of the driver when an angle of rotation of the main shaft is substantially in a range of 5° to 35°, wherein the angle of rotation of the main shaft is 0° when the needle bar is at a top dead point.

6 Claims, 5 Drawing Sheets

DBS

DPS

DBS

BOBBIN CASING ASSEMBLY AND SEWING MACHINE HAVING SAME

BACKGROUND OF THE INVENTION

1. Field of the Invention

This invention relates to a sewing machine, and more particularly, to a bobbin casing for a sewing machine.

2. Description of the Related Art

A full-turn shuttle and a half-turn shuttle are two examples of available shuttle bodies in sewing machines. In one type of the half-turn shuttle hook (hereinafter referred to as a "DBS shuttle hook"), the needle comes between an upper thread loop and the bobbin. The needle drop position is between the bobbin thread lead-out point of the bobbin and the beak of the shuttle body. In another type of the half-turn shuttle hook (hereinafter referred to as a "DPS shuttle hook"), the upper thread loop comes between the needle and the bobbin. Here, the beak of the shuttle body is between the needle drop position and the bobbin thread lead-out point of the bobbin.

A sewing machine incorporating a DBS shuttle hook forms perfect stitches in a forward feeding direction in which a fabric is fed in a right-to-left direction as viewed from the operator, and forms hitch stitches in a reverse feeding operation (in which a fabric is fed in a left-to-right direction as viewed from the operator). Hence, the sewing machine of this type is extensively employed for lock stitching.

In general, in lock stitching, perfect stitching should be employed to form straight stitches from the view point of the quality of stitches, and in order to eliminate the difficulty of a thread getting loose at both ends of a line of stitches, the latter should be ended by hitch stitching. In order to meet these requirements, a DBS shuttle hook is employed. However, a sewing machine having a DBS shuttle hook is not suitable for omnidirectional stitching.

A sewing machine incorporating a DPS shuttle hook is also known in the art (see, e.g., Japanese Patent No. 99353). This type of sewing machine is capable of forming perfect stitches in both the forward feeding direction and the reverse feeding direction and is thus suitable for omnidirectional stitching. However, this type of sewing machine is not popularly employed in the art yet. Additionally, it should be noted that the DPS shuttle hook responds well to the variation in thickness of a fabric, and is thus suitable for sewing a heavy weight fabric and for use with a thread large in yarn number count.

FIG. 4 shows a conventional bobbin casing 100 used with a half-turn shuttle. As shown in FIG. 4, the bobbin casing 100 has an engaging member 101, in which a thread hole 102 is formed. A bobbin thread 104 supplied from a bobbin 103 accommodated in the bobbin casing 100 is passed through the thread hole 102 of the horn 101 of the bobbin casing 100. The bobbin casing is set in the sewing machine (not shown) such that it faces forward so that it is conveniently handled by an operator when it is set in or removed from the sewing machine.

The direction of rotation of the shuttle body should be determined so that the upper thread on the needle side is twistable because a sewing thread for a sewing machine is fundamentally of Z-twist. Thus, in the case of a DBS shuttle hook, the direction of rotation of the shuttle body is clockwise as viewed from the operator side. However, in the case of a DPS shuttle hook, the direction of rotation of the shuttle body is counterclockwise.

A sewing machine incorporating a DBS shuttle hook and a sewing machine incorporating a DPS shuttle hook will now be compared with reference to FIGS. 5(*a*) and 5(*b*).

In FIG. 5(*a*), reference numeral 111 designates the DBS shuttle hook; 112, the beak of the DBS shuttle hook 111; 113, the needle; 114, the upper thread; and R, the upper thread loop. In FIG. 5(*b*), reference numeral 115 designates the DPS shuttle hook; and 116, the beak of the DPS shuttle hook 115.

In the case where the DBS shuttle hook 111 is employed, the distance (1) between the needle drop point and the bobbin thread lead-out point is as shown in FIG. 5(*a*). In the case where the DPS shuttle hook 115 is employed, the distance (2) between the needle drop point and the bobbin thread lead-out point is as shown in FIG. 5(*b*). As shown in FIGS. 5(*a*) and 5(*b*), the distance (2) is larger than the distance (1).

In a sewing machine employing the DPS shuttle hook 115, the distance (2) between the needle drop point and the bobbin thread lead-out point is shifted laterally (offset) as much as (the width of the lace of the shuttle body +α (alpha)) when compared with the distance (1) between the needle drop point and the bobbin thread lead-out point in the case where the DBS shuttle hook 11 is employed.

As a result, the force of the thread take-up lever (not shown) used to pull up the upper thread 114 is markedly decreased. This fundamental factor adversely affects the tightening of the thread. Incidentally, when the needle 113 is held from passing the fabric, which is fed, the thread take-up lever tightens the thread.

FIGS. 6(*a*) and 6(*b*) show states of the shuttle bodies with a fabric feeding mechanism in operation. FIG. 6(*a*) shows the horn 101 which stops the rotation of the bobbin casing in a sewing machine using the DBS shuttle hook. FIG. 6(*b*) shows the horn 101 which stops the rotation of the bobbin casing in a sewing machine using the DPS shuttle hook. FIG. 6(*a*) shows the relationships of a shuttle race ring 121, an engaging groove 122, a needle plate 123, and a needle hole (needle passing hole) 124. The arrow A designates a fabric feeding direction, and the arrow CW indicates the direction of rotation of the DBS shuttle hook 111 (clockwise). In FIG. 6(*b*), the arrow B designates a fabric feeding direction, and the arrow CCW designates the direction of rotation of the DPS shuttle hook (counterclockwise). FIGS. 7(*a*) and 7(*b*) are enlarged diagrams showing the essential components shown FIGS. 6(*a*) and 6(*b*) respectively.

The bobbin thread 104 is pulled by the fabric feeding force as indicated by the arrows A and B in FIGS. 6(*a*) and 6(*b*). As a result, when the DBS shuttle hook 111 is used, the bobbin casing 100 is turned clockwise as shown in FIG. 6(*a*). When the DPS shuttle hook 115 is used, the bobbin casing 100 is turned counterclockwise as shown in FIG. 6(*b*).

Furthermore, in the case of the DBS shuttle hook 11, as shown in FIG. 7(*a*), the horn 101 is pushed to the right against the engaging groove 122 of the shuttle race ring 121 which stops the rotation of the bobbin casing 100. In the case of the DPS shuttle hook 115, as shown in FIG. 7(*b*), the horn 101 is pushed to the left against the engaging groove 122 of the shuttle race ring 121.

In this connection for the upper thread 114, a movable side (the side of the needle 113) and a stationary side (the side of the fabric) should be considered. In the case of the DBS shuttle hook 111, as shown in FIG. 7(*a*), the loop R of the upper thread on the movable side (the side of the needle 113) is readily pulled up by the force of the thread take-up lever and enters the space between the horn 101 and the right wall surface of the engaging groove 122.

By comparing FIGS. 5(*a*) and 5(*b*), it is apparent that the offset of the loop R is much smaller in the case of the DBS shuttle hook 111 than in the case of the DPS shuttle hook 115. In the case of the DBS shuttle hook, the loop is pulled upwardly with respect to the horn 101 which readily permits the passage of the upper thread 114.

On the other hand, in the case of the DPS shuttle hook 115, as shown in FIG. 7(*b*), the loop R of the upper thread 114 enters the space between the horn 101 and the left wall surface of the engaging groove 122 coming on the stationary side (on the side of the fabric). Therefore, the force of the thread take-up lever is hardly transmitted to the loop which is also offset more than in the case of the DBS shuttle hook 111. In addition to this disadvantage, the upper thread 114 turns around the horn 101 from above making it rather difficult to disengage the horn 101.

These difficulties depend on the fabric feeding direction and the stitching pitch. They are most significant, however, when the stitching pitch is large, and the fabric is fed in a right-to-left direction. As a result of these difficulties, the thread is unevenly tightened.

Although it depends on the timing of the entrance of a driver adapted to drive the shuttle body, the upper thread 114 is generally shaped as shown FIGS. 9(*a*) and 9(*b*) when leaving the DPS shuttle hook 115. FIGS. 9(*a*) and 9(*b*) show the relationship of the driver 131.

In this case, the thickness of the inner side surface of the driver 131 and its curvature (radius), and the width of the right and left flanges of the thread disengaging section must be taken into account. If the driver 131 is made thin, then the upper thread 114 may be well tightened thereby decreasing its resistance. However, by making the driver 131 thin, another problem is created. Specifically, if the particular thread used is high in twist movement or is liable to run (vibrate), the thread becomes twisted when the tension is high thereby causing uneven tightening or formation of unwanted loops.

To achieve operational balance, it is important that the upper thread disengages from the driver 131 slightly later in time than when the upper thread disengages from the horn 101 of the bobbin casing 100. This will eliminate the difficulties of the thread becoming unintentionally twisted or forming unwanted loops or knots.

In the case of the DPS shuttle hook 115 as described with reference to FIG. 7(*b*), difficulties arise because of the increased resistance of the thread 114 as is pushed passed the arrow associate with the (*), and the delayed timing of the thread leaving the horn compared with the thread leaving the driver 131. These difficulties cause the upper thread 114 to remain over the horn 101 of the bobbin casing 100. As a result, the thread 114 may be caught by the horn 101 of a thread disengaging section, which is offset more than in the case of the DBS shuttle hook, and pulled sideways, thus forming unwanted loops and knots.

SUMMARY OF THE INVENTION

The present invention has been made in view of the above circumstances and has an object to provide a bobbin casing for a sewing machine which is designed so that, in the case where the thread disengaging section is offset more than in the case of the DBS shuttle hook, it may be applied to a sewing machine using the DPS shuttle hook wherein the upper thread is smoothly disengaged therefrom, thus preventing the formation of unwanted loops or knots and resulting in high quality stitches.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a bobbin casing assembly for a sewing machine is provided, the sewing machine having a driver, a main shaft and a needle bar, the bobbin casing assembly comprising a bobbin casing and an engaging member protruding outwardly from the bobbin casing, an upper end of the engaging member being disposed below an upper surface of the driver when an angle of rotation of the main shaft is substantially in a range of 5° to 35°, wherein the angle of rotation of the main shaft is 0° when the needle bar is at a top dead point.

To further achieve the objects and in accordance with the purpose of the invention, as embodied and broadly described herein, a sewing machine is also provided, comprising a driver, a main shaft, a needle bar, and a bobbin casing assembly, the bobbin casing assembly including a bobbin casing and an engaging member protruding outwardly from the bobbin casing, an upper end of the engaging member being disposed below an upper surface of the driver when an angle of rotation of the main shaft is substantially in a range of 5° to 35°, wherein the angle of rotation of the main shaft is 0° when the needle bar is at a top dead point.

BRIEF DESCRIPTION OF THE DRAWING(S)

The accompanying drawings, which are incorporated in and constitute a part of this specification illustrate embodiments of the invention and, together with the description, serve to explain the objects, advantages and principles of the invention. In the drawings:

FIG. 5(*b*) is a partial cut-away side view of a conventional sewing machine using the DPS shuttle hook showing the distance between the needle drop point and the bobbin thread lead-out point;

FIG. 6(*b*) is a front view of the horn of the bobbin casing being prevented from turning in a conventional sewing machine using the DPS shuttle hook;

FIG. 7(*b*) is an enlarged front view of the essential components of the horn of the bobbin casing being prevented from turning in a conventional sewing machine using the DPS shuttle hook;

FIG. 9(*b*) is a front view of the horn of the bobbin casing as the upper thread loop disengages in a conventional sewing machine using the DPS shuttle hook.

DETAILED DESCRIPTION OF THE PREFERRED EMBODIMENTS

In the bobbin casing of the invention, the upper end of the horn is adapted to prevent the rotation of the bobbin casing and is located below the upper surface of the driver when the angle of rotation of the main shaft of the sewing machine is substantially in a range of 5° to 35°, wherein the angle of rotation of the main shaft is 0° when the needle bar is at a top dead point. Further, the horn is shorter than the conventional horn. Hence, the upper thread is smoothly disengaged from the horn. Furthermore, the present horn has no thread hole, allowing the thread to disengage from the horn more smoothly.

The bobbin casing having the shortened horn is provided for a sewing machine which employs a half-turn shuttle. Hence, even if the thread disengaging section has a greater offset than in the case of the DBS shuttle hook, the upper thread is smoothly disengaged from the horn.

A bobbin casing for a sewing machine according to the invention will now be described with reference to FIGS. 1 through 3.

Figure 1:
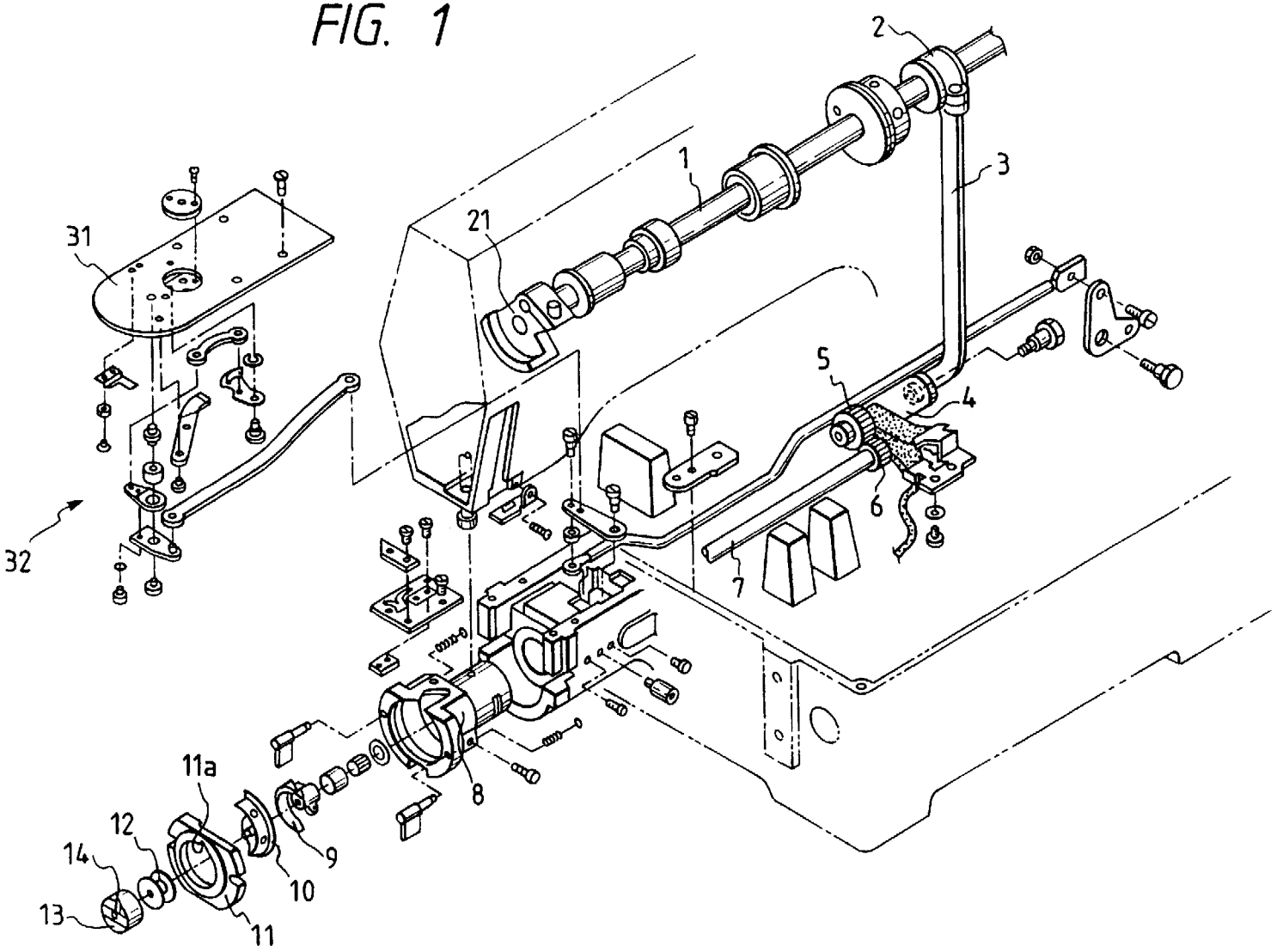
FIG. 1 is an exploded perspective view of a shuttle driving device in a sewing machine according to one embodiment of the invention.

As show in FIG. 1, a shuttle driving device according to the invention comprises a spindle (or main shaft) 1, a crank section 2, a crank rod 3, an oscillating rock shaft 4, gears 5 and 6, a lower shaft 7, a shuttle race body 8, a driver 9, a shuttle body (or DPS shuttle hook) 10, a shuttle race ring 11, a bobbin 12, a bobbin casing 13, a horn of the bobbin casing 14, a counter balance 21, a needle plate 31, and a thread trimmer 32.

The main shaft 1 has a pulley (not shown) at the right end to which the torque of the electric motor is applied through an endless belt. The main shaft 1 is coupled to crank rod 3 via crank section 2. The lower end portion of the crank rod 3 is eccentrically coupled to the oscillating rock shaft 4.

The gears 5 and 6 are mounted on the oscillating rock shaft 4 and the lower shaft 7, respectively, such that they are engaged with each other. Near the left end of the lower shaft 7, the shuttle race body 8 is fixed to the sewing machine body.

The driver 9 is coupled to the left end of the lower shaft 7, and rotatably provided inside the shuttle race body 8. In addition, the DPS shuttle hook 10, which is the shuttle body driven by the driver 9, is also rotatably provided inside the shuttle race body 8.

The DPS shuttle hook 10 has a race along its outer periphery, so that it is slidably set in the shuttle race body 8 through the surface of the race. The DPS shuttle hook 10 is turned counterclockwise by the driver 9.

The shuttle race ring 11 is fixed to the shuttle race body 8. The bobbin casing 13 accommodating the bobbin 12 is set in the shuttle race body 8 through the opening of the shuttle race ring 11.

The engaging member 14 protrudes outwardly from the bobbin casing 13. The shuttle race ring 11 has an engaging groove 11*a* with which the horn 14 is engageable.

The counter balance 21 is coupled to the left end of the main shaft 1. In front of the counter balance 21, a thread take-up lever, needle bar crank, needle bar crank rod, needle bar, and needle are provided, as is well known to one of ordinary skill in the art.

The needle plate 31 is provided above the shuttle race body 8. The thread trimmer 32, in addition to various other elements as shown in FIG. 1, are provided between the needle plate 31 and the shuttle race body 8.

The sewing machine thus designed operates as follows. First, the torque of the motor is applied through the endless belt to the pulley, so that the main shaft 1 is rotated to drive the needle (not shown), while the full turn motion of the main shaft 1 is converted into a swinging motion with the aid of the crank section 2 and the crank rod 3.

The swinging motion of the oscillating rock shaft 4 is transmitted through the gears 5 and 6 to the lower shaft 7. That is, it is converted into the half turn motion of the lower shaft 7. Hence, the DPS shuttle hook 10, being driven by the driver 9 integral with the lower shaft 7, performs a half turn motion in the counterclockwise direction.

Figure 2:
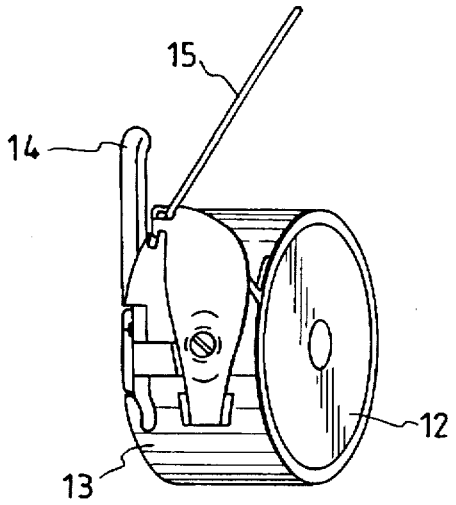
FIG. 2 is a perspective view of a bobbin casing according to the invention.
Figure 4:
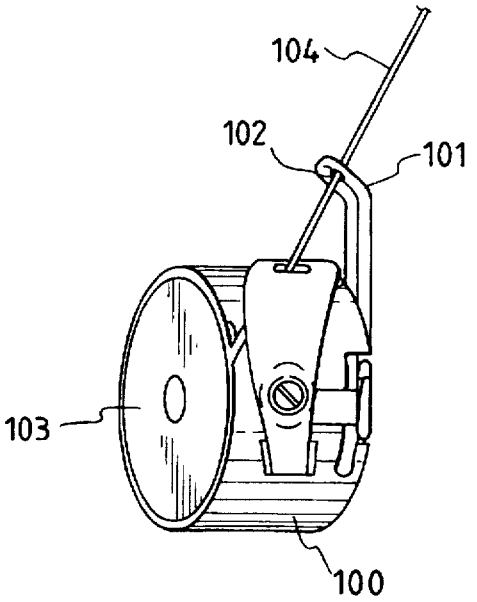
FIG. 4 PRIOR ART
FIG. 4 is a perspective view of a conventional bobbin casing provided for a conventional half-turn shuttle.
Figure 5A:
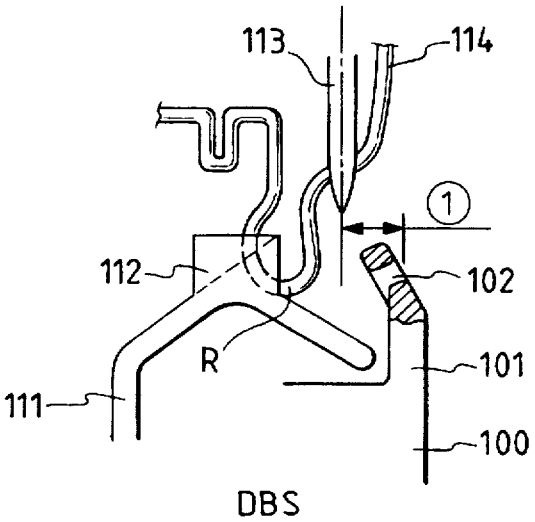
FIG. 5(a) PRIOR ART
FIG. 5(*a*) is a partial cut-away side view of a conventional sewing machine using the DBS shuttle hook showing the distance between the needle drop point and the bobbin thread lead-out point.
Figure 5B:
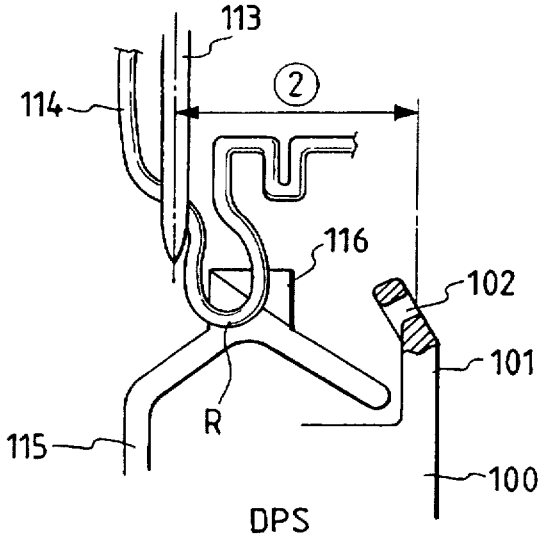
FIG. 5(b) PRIOR ART
Figure 6A:
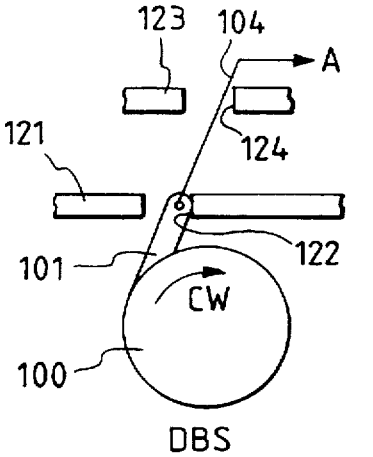
FIG. 6(a) PRIOR ART
FIG. 6(*a*) is a front view of the horn of the bobbin casing being prevented from turning in a conventional sewing machine using the DBS shuttle hook.
Figure 6B:
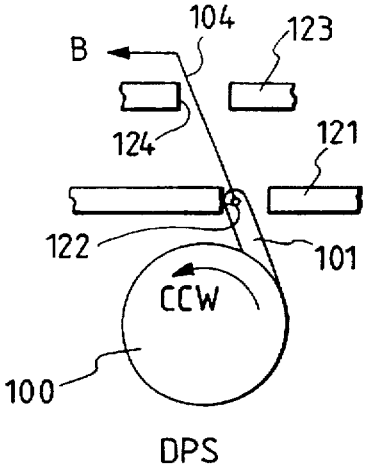
FIG. 6(b) PRIOR ART
Figure 7A:
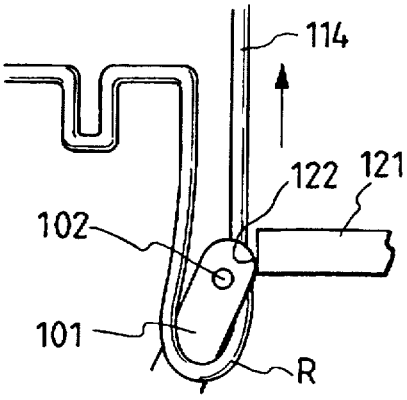
FIG. 7(a) PRIOR ART
FIG. 7(*a*) is an enlarged front view of the essential components of the horn of the bobbin casing being prevented from turning in a conventional sewing machine using the DBS shuttle hook.
Figure 7B:
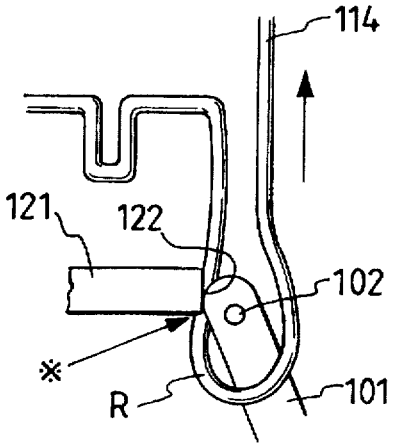
FIG. 7(b) PRIOR ART
Figure 8:
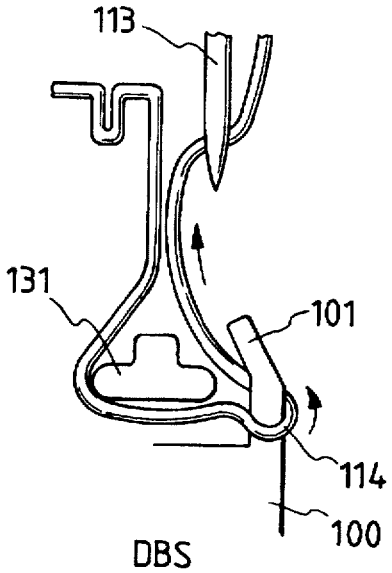
FIG. 8 PRIOR ART
FIG. 8 is a side view of the horn of the bobbin casing as the upper thread loop disengages in a conventional sewing machine using the DBS shuttle hook.
Figure 9A:
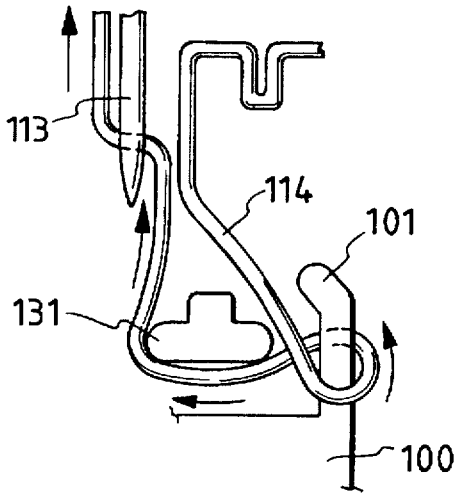
FIG. 9(a) PRIOR ART
FIG. 9(*a*) is a side view of the horn of the bobbin casing as the upper thread loop disengages in a conventional sewing machine using the DPS shuttle hook.
Figure 9B:
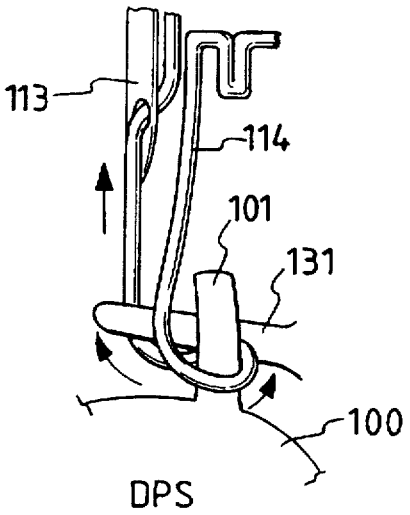
FIG. 9(b) PRIOR ART

As shown in FIG. 2, the amount by which the horn 14 of the present invention protrudes from the bobbin casing 13 is less than that of the conventional horn 101 of FIG. 4. Also, unlike the conventional horn 101, horn 14 of the present invention has no thread hole. Hence, the bobbin thread 15 wound on the bobbin 12 is merely led out of the bobbin casing 13 irrespective of the horn 14.

Figure 3:
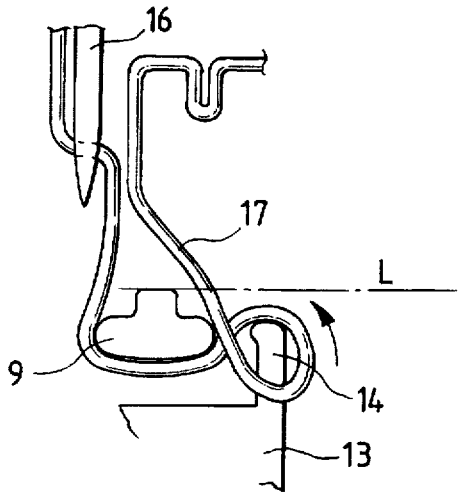
FIG. 3 is a partial side view of the present invention showing the disengagement of the upper thread from the horn of the bobbin casing.

In the present invention, the length of the horn 14 is determined from the position of the driver 9 as shown in FIG. 3. FIG. 3 also shows the needle 16, the upper thread 17, and the upper surface L of the driver 9. That is, FIG. 3 shows the position of the driver 9 when the angle of rotation of the main shaft 1 is in a range of 5° to 35°, wherein the angle of rotation of the main shaft is 0° when the needle bar is at a top dead point. In this embodiment, the length of the horn 14 of the bobbin casing 13 is determined so that, under the above-described condition, the upper end of the horn 14 comes below the upper surface L of the driver 9.

In the bobbin casing 13 provided for the DPS shuttle hook 10, the horn 14 is shortened, such that it is able to engage with the engaging groove 11*a* of the shuttle race ring 11 to prevent the rotation of the bobbin casing, and has no thread hole. Hence, even though the thread disengaging section in the case of the DPS shuttle hook has a greater offset than in the case of the DBS shuttle hook, the upper thread 17 smoothly disengages from the horn 14.

Accordingly, the problem of the thread forming unwanted loops and knots associated with the prior art is eliminated in the present invention. Hence, with the bobbin casing 13 of the present invention applied to a sewing machine using the DPS shuttle hook, the resulting stitches are of high quality.

In the above-described embodiment, the bobbin casing is provided for the DPS shuttle hook; however, the invention is not limited thereto or thereby. That is, the technical concept of the invention may be applied to bobbin casings provided for shuttles other than the DPS shuttle hook.

Furthermore, the configuration of the bobbin casing is not always limited to the foregoing description. In addition, the bobbin casing may be suitably changed or modified in structure without departing from the spirit of the invention.

As was described above, in the bobbin casing of the invention, the upper end of the horn is adapted to prevent the rotation of the bobbin casing and is located below the upper surface of the driver when the angle of rotation of the main shaft of the sewing machine is substantially in a range of 5° to 35°, wherein the angle of rotation of the main shaft is 0° when the needle bar is at a top dead point. In addition, the horn according to the invention is shorter than the conventional horn. Hence, the upper thread is smoothly disengaged from the horn, which eliminates the difficulty of the thread forming unwanted loops or knobs. Accordingly, the resulting stitches are of high quality.

Furthermore, in the preferred embodiment, the horn has no thread hole, thereby allowing the thread to disengage from the horn more readily.

The bobbin casing having the shortened horn may be provided for a sewing machine which employs a half-turn shuttle. Hence, even if the thread disengaging section has a greater offset than in the case of the DBS shuttle hook, the upper thread is smoothly disengaged from the horn.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sewing machine, comprising:

a driver;

a main shaft;

a needle bar; and a bobbin casing assembly, the bobbin casing assembly including a bobbin casing, and an engaging member protruding outwardly from the bobbin casing, an upper end of the engaging member being disposed below an upper surface of the driver when an angle of rotation of the main shaft is substantially in a range of 5° to 35°, wherein the angle of rotation of the main shaft is 0° when the needle bar is at a top dead point.

2. The sewing machine of claim 1, wherein the engaging member has no thread hole.

3. The sewing machine of claim 1, wherein the sewing machine further comprises a half-turn shuttle.

4. The sewing machine of claim 3, wherein the half-turn shuttle is any one of a DPS half-turn shuttle and a DBS half-turn shuttle.

5. The sewing machine of claim 2, wherein the sewing machine further comprises a half-turn shuttle.

6. The sewing machine of claim 5, wherein the half-turn shuttle is any one of a DPS half-turn shuttle and a DBS half-turn shuttle.

* * * * *